US010501260B2

(12) United States Patent
Brennan, Jr.

(10) Patent No.: US 10,501,260 B2
(45) Date of Patent: Dec. 10, 2019

(54) BORDER WALL OR FENCE

(71) Applicant: Sea Box, Inc., East Riverton, NJ (US)

(72) Inventor: James F. Brennan, Jr., Moorestown, NJ (US)

(73) Assignee: Sea Box, Inc., East Riverton, NJ (US)

( * ) Notice: Subject to any disclaimer, the term of this patent is extended or adjusted under 35 U.S.C. 154(b) by 0 days.

(21) Appl. No.: 15/919,426

(22) Filed: Mar. 13, 2018

(65) Prior Publication Data

US 2018/0273288 A1 Sep. 27, 2018

Related U.S. Application Data

(60) Provisional application No. 62/475,997, filed on Mar. 24, 2017.

(51) Int. Cl.

| | |
|---|---|
| ***E04H 17/14*** | (2006.01) |
| ***E04H 7/00*** | (2006.01) |
| ***B65D 88/02*** | (2006.01) |
| ***E04B 2/62*** | (2006.01) |
| ***E04B 2/16*** | (2006.01) |
| *B65D 88/12* | (2006.01) |

(52) U.S. Cl.
CPC ..... *B65D 88/027* (2013.01); *E04B 2/16* (2013.01); *E04B 2/62* (2013.01); *B65D 88/121* (2013.01)

(58) Field of Classification Search
CPC ..... E04H 17/00; E04H 17/14; E04H 17/1404; E04H 7/00; B65D 88/027; E04B 1/08; E04B 2/14
See application file for complete search history.

(56) References Cited

U.S. PATENT DOCUMENTS 837,962 A * 12/1906 Rice ..... E02D 29/025
2,695,159 A * 11/1954 Bridwell ..... E04H 17/16 256/19
4,599,829 A * 7/1986 DiMartino, Sr. ..... E04B 1/3483 410/79
6,012,872 A * 1/2000 Perry ..... E02B 3/108 220/1.6

(Continued)

FOREIGN PATENT DOCUMENTS

JP 4-347283 * 12/1992 ..... E04H 17/14
JP 5-71253 * 3/1993 ..... E04H 17/16

OTHER PUBLICATIONS www.offgridworld.com/zombie-fortress. Aug. 15, 2012.*

(Continued)

*Primary Examiner* — Michael P Ferguson
(74) *Attorney, Agent, or Firm* — Norman E. Lehrer

(57) ABSTRACT

A border wall or fence is constructed from a plurality of existing ISO steel shipping containers which are connected together both horizontally and vertically at their corners using conventional corner locks so as to present a continuous physical barrier of any selected length. The containers are stacked three or four high with the bottommost containers recessed into the ground and filled at least partially with dirt or sand. The uppermost containers are open at their ends to allow personnel to walk or drive through the length of the wall. Windows are also formed in the upper containers to allow personnel to view the area around the wall. Gated openings can be formed periodically to allow for passage through the wall.

4 Claims, 7 Drawing Sheets

(56) References Cited

U.S. PATENT DOCUMENTS

| | | | | |
|---|---|---|---|---|
| 6,925,761 | B1 * | 8/2005 | De La Marche | E04B 1/34815 52/220.1 |
| 6,983,567 | B2 * | 1/2006 | Ciotti | E04B 1/3442 52/64 |
| 7,827,738 | B2 * | 11/2010 | Abrams | E04B 1/003 52/79.1 |
| 8,371,091 | B2 * | 2/2013 | Graf | E04B 1/34305 52/745.02 |
| 9,016,001 | B2 * | 4/2015 | Heger | E04B 1/34357 52/79.5 |
| 2010/0025407 | A1 * | 2/2010 | Benson | B65D 88/022 220/564 |
| 2013/0022404 | A1 * | 1/2013 | Stinson | E02D 17/18 405/117 |

OTHER PUBLICATIONS

This Firm's U.S.-Mexico Border Wall Suggestion Includes Shipping Containers and a Mixed-Use Development, Published Mar. 10, 2017, Downloaded Mar. 21, 2017.

This Alternative US-Mexico Border Wall Is Made From Recycled Shipping Containers| Inhabit-Green Design, Published Dec. 19, 2016, Downloaded Mar. 21, 2017.

* cited by examiner

BORDER WALL OR FENCE

CROSS-REFERENCE TO RELATED APPLICATION

The present application claims the benefit of prior provisional application Ser. No. 62/475,997, filed Mar. 24, 2017.

FIELD OF THE INVENTION

The present invention is directed toward a physical barrier system constructed from International Standardization Organization (ISO) steel shipping containers. The purpose of the invention is to prevent or deter persons or motor vehicles from crossing a line such as a border or from entering a secured area.

BACKGROUND OF THE INVENTION

There is much talk in recent years about building a border wall between the United States and Mexico. From political and social standpoints, there is much disagreement as to whether such a wall should be built. There is agreement, however, that the cost of building the same using conventional building techniques would be prohibitive. It is estimated that the cost would exceed 25 billion dollars and take many years to complete.

As an alternative to building the border wall using conventional means, it has been proposed to build the same from ISO shipping containers. It is estimated that there are thousands of used shipping containers in the world that are currently just sitting idle. If properly designed, a wall could be constructed using these containers for a fraction of the cost of conventional construction.

ISO shipping containers are made of steel and are either 40 feet long or 20 feet long and are generally 8 feet wide and either 8.5 feet or 9.5 feet tall. They are normally six-sided structures and are made from solid steel. Each of the eight corners of conventional shipping containers includes a corner casting that allows the container to be connected to an adjacent container either end to end, top to bottom or side to side. This is accomplished using well known corner connectors such as described, for example, in U.S. Pat. Nos. 3,722,714; 3,752,511; 6,729,098 and 9,120,618, the contents of which are incorporated herein by reference.

The containers can be connected end-to-end horizontally so as to theoretically be any length to provide a protective barrier or wall. By horizontally connecting the necessary number of 40-foot or 20-foot containers together, the resulting barrier row can extend to any desired length. Such a system could be used, therefore, to build a border wall 1,500 miles long or a much shorter wall or fence covering only 100 miles or one mile or just a city block.

There is, therefore, a need for a system for building a wall or fence that is substantially cheaper than conventional construction systems and that can be used to more quickly construct a wall of any length including a border wall between the United States and Mexico if it is going to be done.

SUMMARY OF THE INVENTION

The present invention is designed to overcome the deficiencies of the prior art discussed above. It is an object of the present invention to provide a wall or fence construction system that is cheaper than conventional systems.

It is another object of the present invention to provide such a wall that is not only cheaper but which can be built in a fraction of the time of conventional systems.

It is a still further object of the present invention to provide such a system that can be built to substantially any length.

In accordance with the illustrative embodiments, demonstrating features and advantages of the present invention, there is provided a border wall or fence constructed from a plurality of existing ISO steel shipping containers which are connected together both horizontally and vertically at their corners using conventional corner locks, so as to present a continuous physical barrier of any selected length. The containers are stacked three or four high with the bottommost containers recessed into the ground and filled at least partially with dirt or sand. The uppermost containers are open at their ends to allow personnel to walk or drive through the length of the wall. Windows are also formed in the upper containers to allow personnel to view the area around the wall. Gated openings can be formed periodically to allow for passage through the wall.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 7:
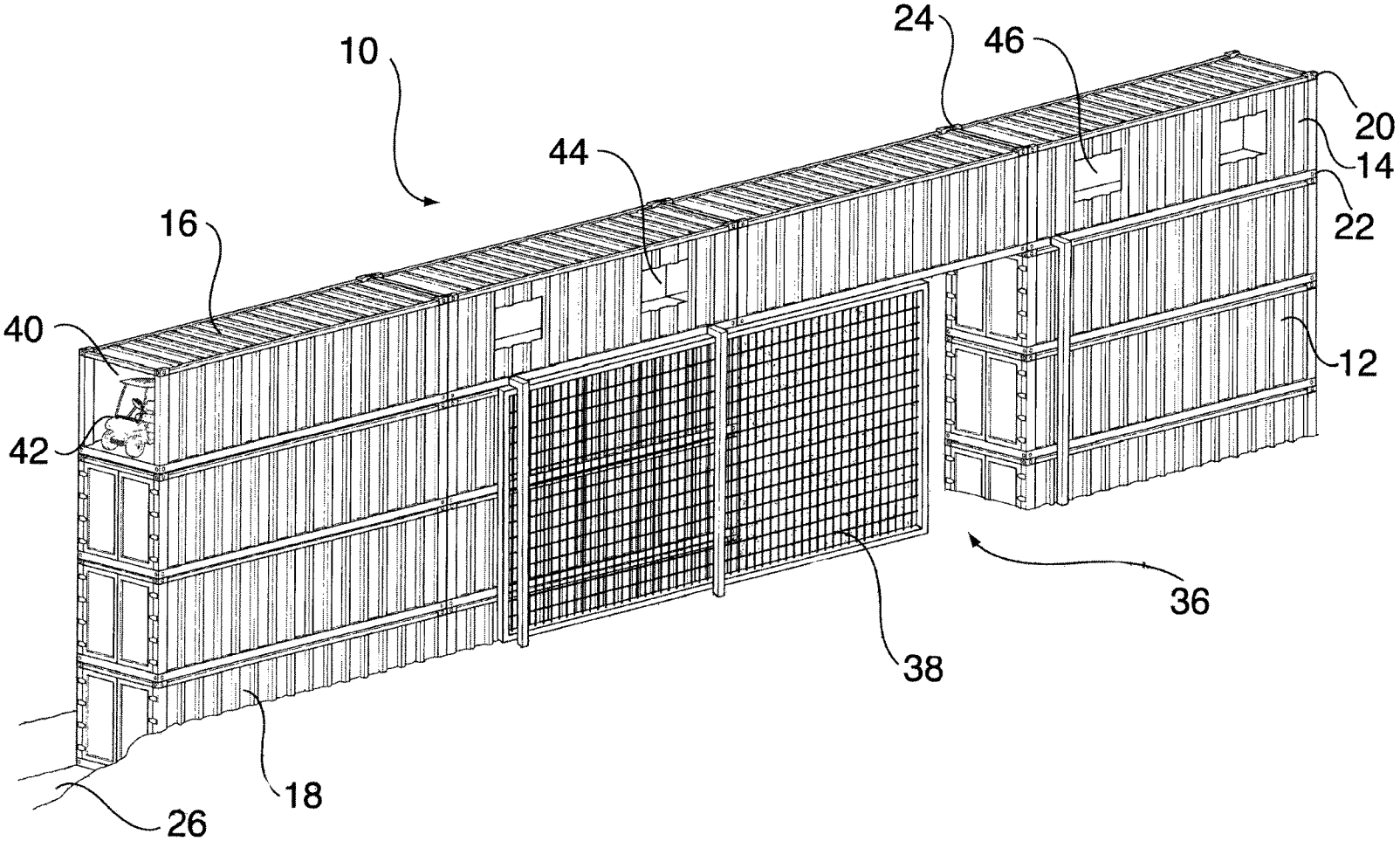
FIG. 7 is a front perspective view similar to FIG. 6 but with a gate for closing the opening in the wall.

Referring now to the drawings in detail wherein like reference numerals have been used throughout the various figures to designate like elements, there is shown in FIG. 7 a wall or fence constructed in accordance with the principles of the present invention and designated generally as 10. The remaining drawings show the wall in various stages of construction and/or variations that may be necessary due to the terrain upon which the wall is built.

As pointed out above, the system 10 is comprised essentially of ISO steel shipping containers such as shown, for example, at 12, 14, 16 and 18 which are connected together both horizontally and vertically at their corners (see, for example, 20, 22, and 24) utilizing conventional well-known corner connectors such as those described above. The containers 12-18 are, per se, well known in the art and are either 40 feet long or 20 feet long. Any number of each or any combination of them can be utilized with the present invention. These containers are also generally 8 feet wide and either 8.5 feet or 9.5 feet tall. As is well known, they are normally six-sided structures made from solid steel.

By connecting the containers together end-to-end horizontally as shown, the structure can, theoretically, be any length to provide a protective barrier or wall. By horizontally connecting the necessary number of 40-foot or 20-foot containers together, the resulting barrier row can extend to the length of a city block, or a mile, or 100 miles, or 1,000 miles or more.

As shown, the containers 12-18 can also be stacked one above the other. While any number of containers can be stacked vertically, in the preferred embodiment of the invention, three or four containers are stacked which would bring the barrier to a height of approximately 30 feet making it practically impossible for someone to climb or jump over the same.

Figure 1:
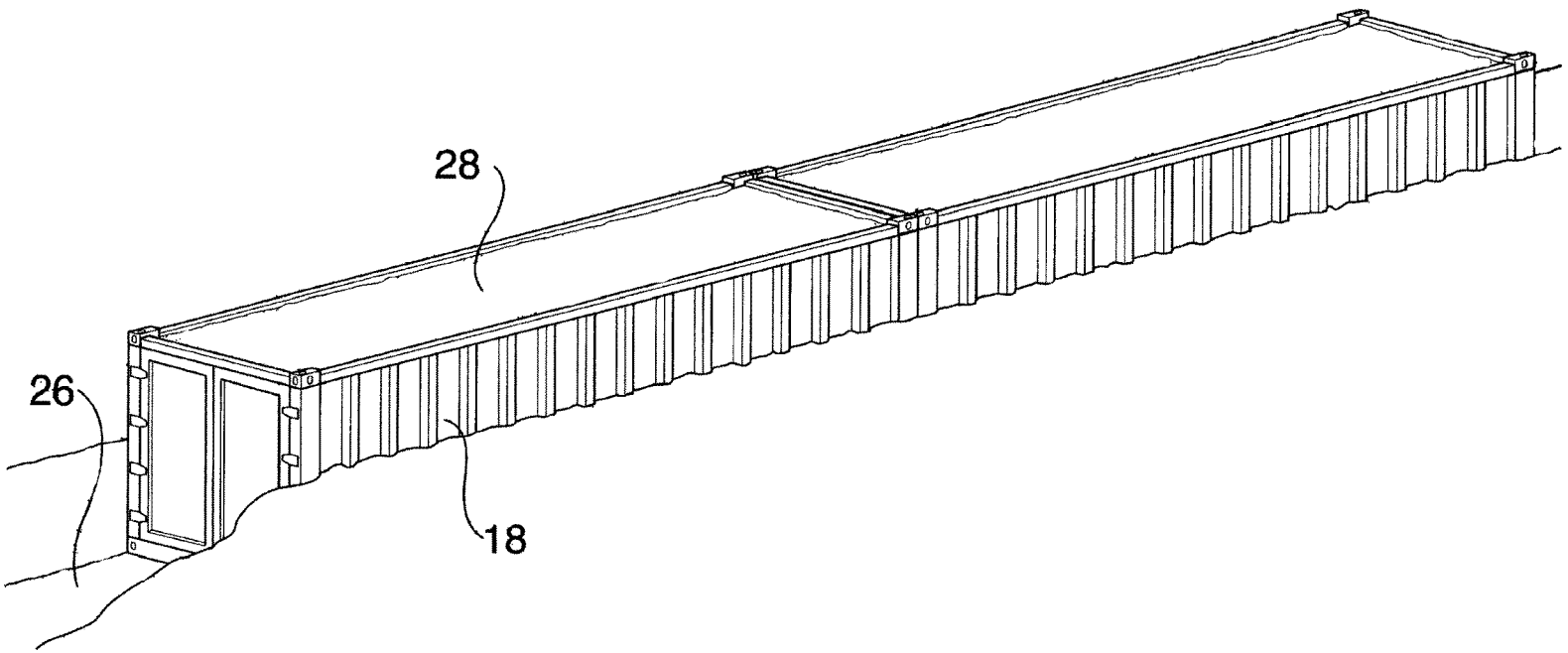
FIG. 1 is a front perspective view of the base portion of the border wall or fence of my invention.
Figure 2:
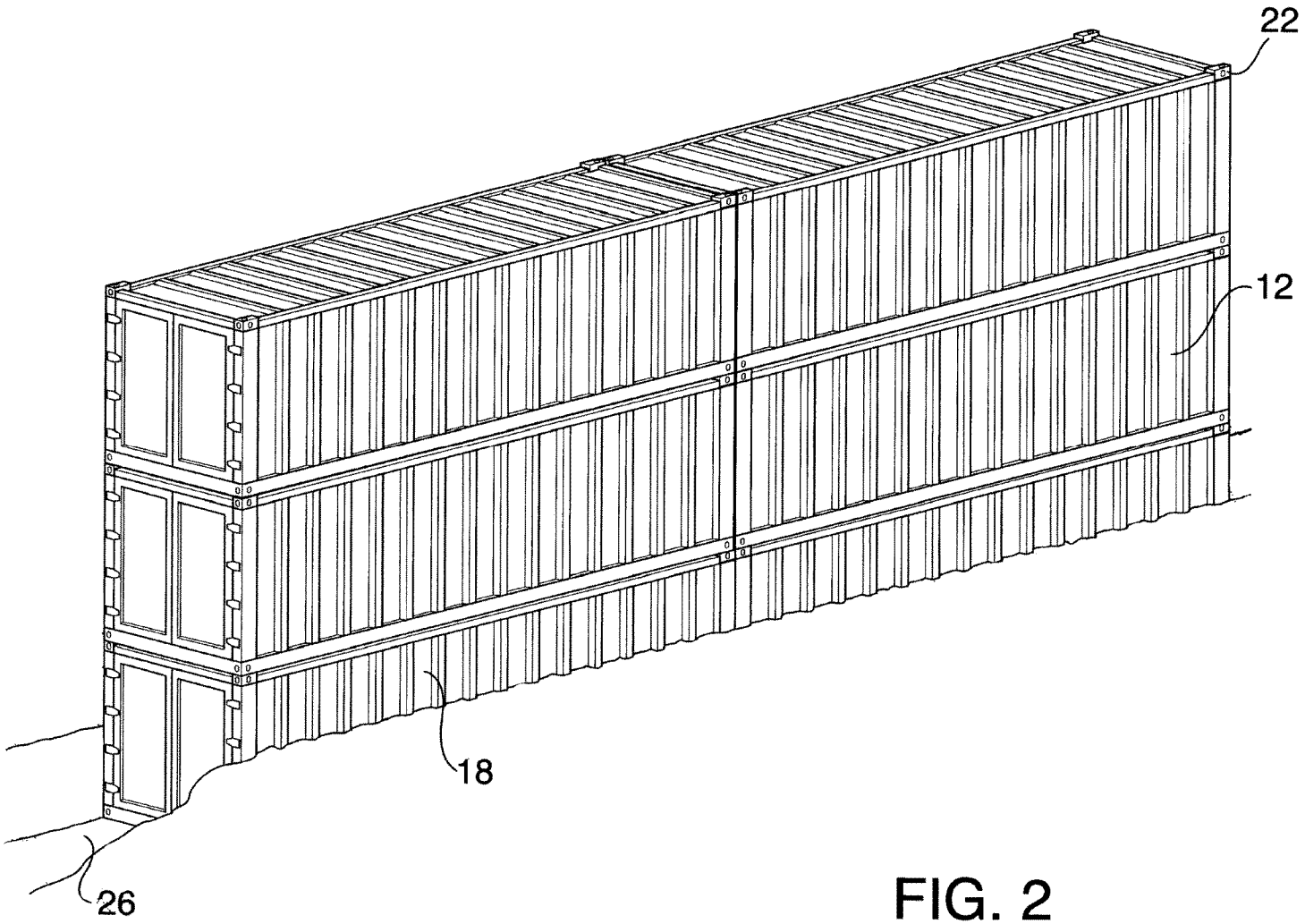
FIG. 2 is a front perspective view showing how the shipping containers are stacked to form the wall or fence.

As can be seen in FIG. 1, the initial step in the wall or barrier construction is to excavate a trench 26 having a depth that is preferably more than half the height of the lowermost container 18. The excavated dirt or sand is then dumped into the lower container to form a sturdy base for the wall 10. This would require the use of bottom containers that do not have roofs or top walls or by removing all or part of the roof of the lowermost containers. A second, third and possibly a fourth row of containers can then be placed thereabove and locked together at their corners to form the wall.

Figure 4:
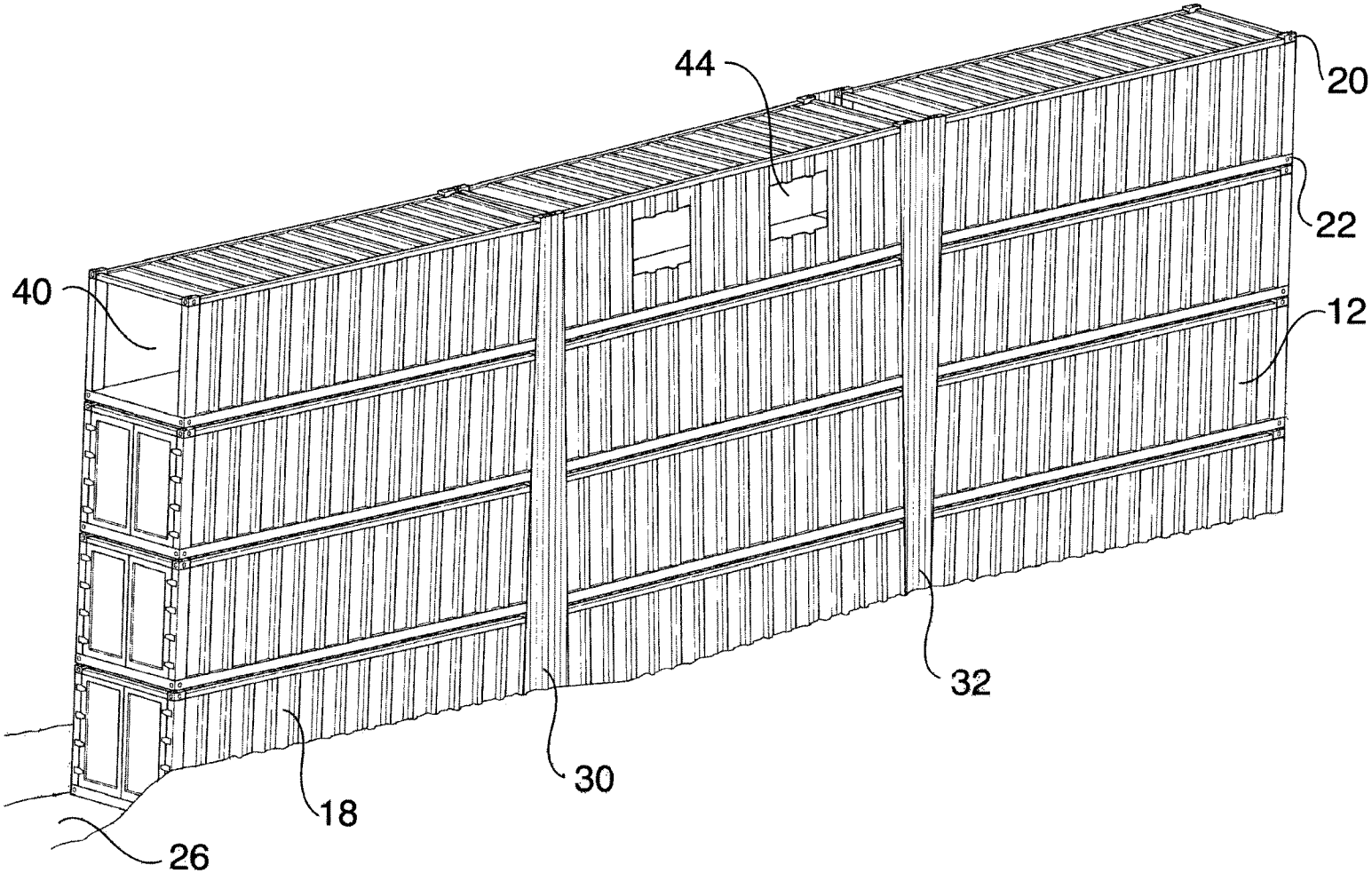
FIG. 4 is a front perspective view showing the upper stacked containers open at their ends and with lookout windows and on uneven terrain.
Figure 5:
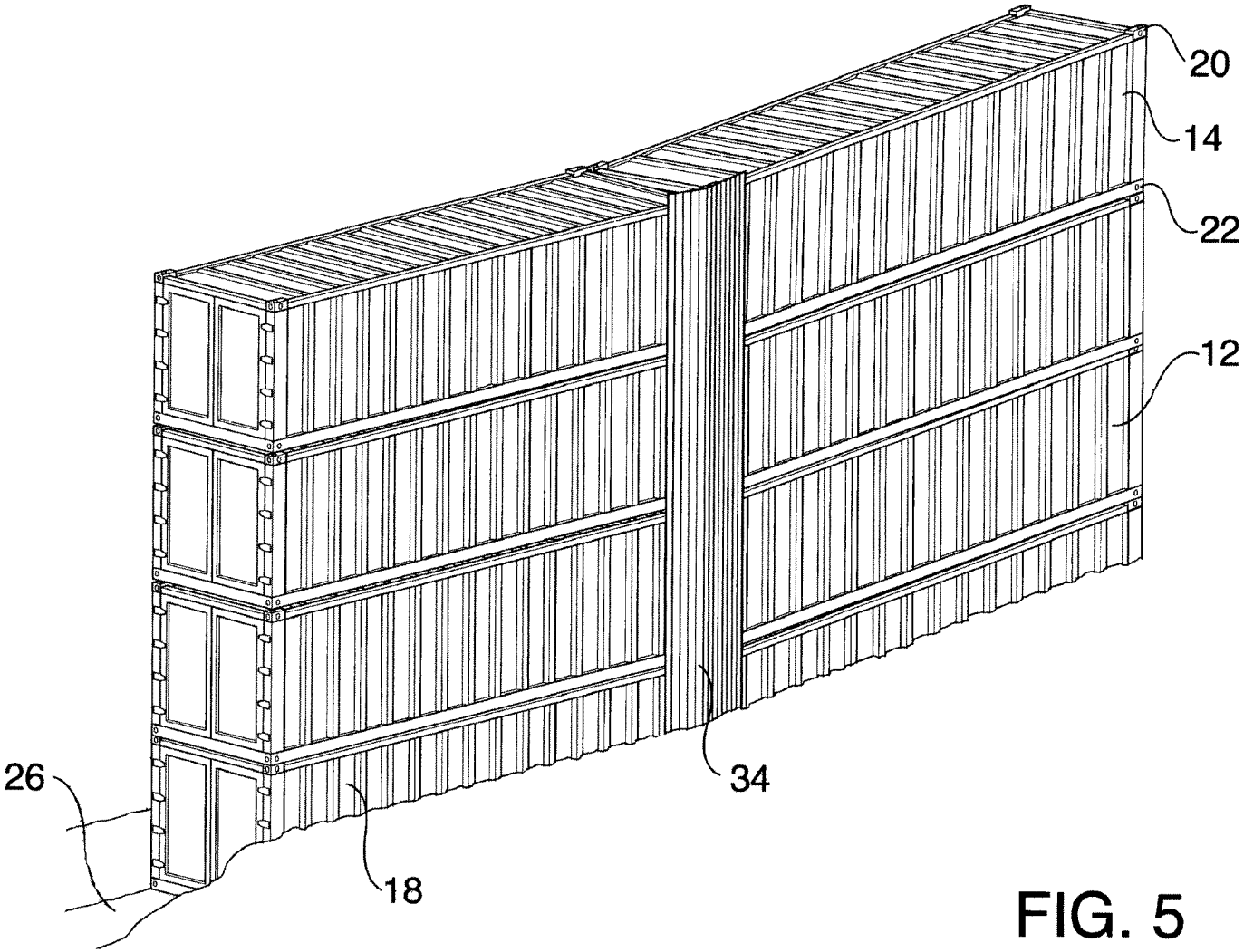
FIG. 5 is a front perspective view similar to FIG. 4 showing how the wall or fence making a turn.

Because the seams between containers can sometimes provide a foothold allowing a person to climb the same, they are preferably covered with a plate metal such as shown at 30, 32 and 34 that is welded thereto. This is particularly necessary when the ends of two containers are not perfectly parallel to each other due to either uneven terrain (for example plates 30 and 32 in FIG. 4) or if it is necessary to turn the wall horizontally (for example plate 34 in FIG. 5). In such a case, larger plates and sometimes wedge-shaped plates must be welded to the ends.

Figure 3:
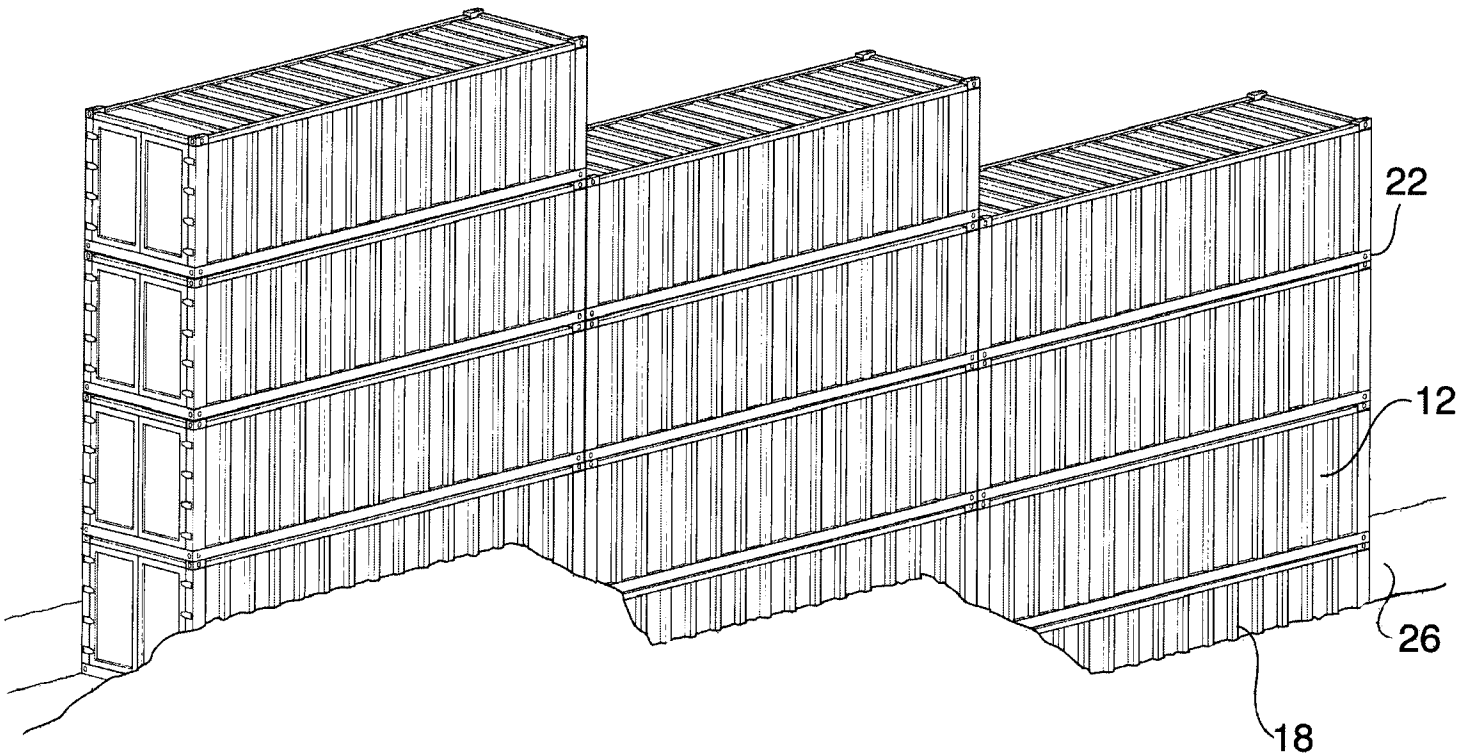
FIG. 3 is a front perspective view similar to FIG. 2 showing how the containers may be stacked when the ground is uneven.

Even further, there are times when the terrain shifts in height significantly over a short distance. This may require that the containers be placed in a somewhat stepped arrangement such as shown in FIG. 3.

Since the outer surfaces of the shipping containers are normally comprised of vertically extending corrugated steel, it is substantially impossible for even a trained athlete to climb the same. If necessary, however, additional smooth steel plates can be added.

Figure 6:
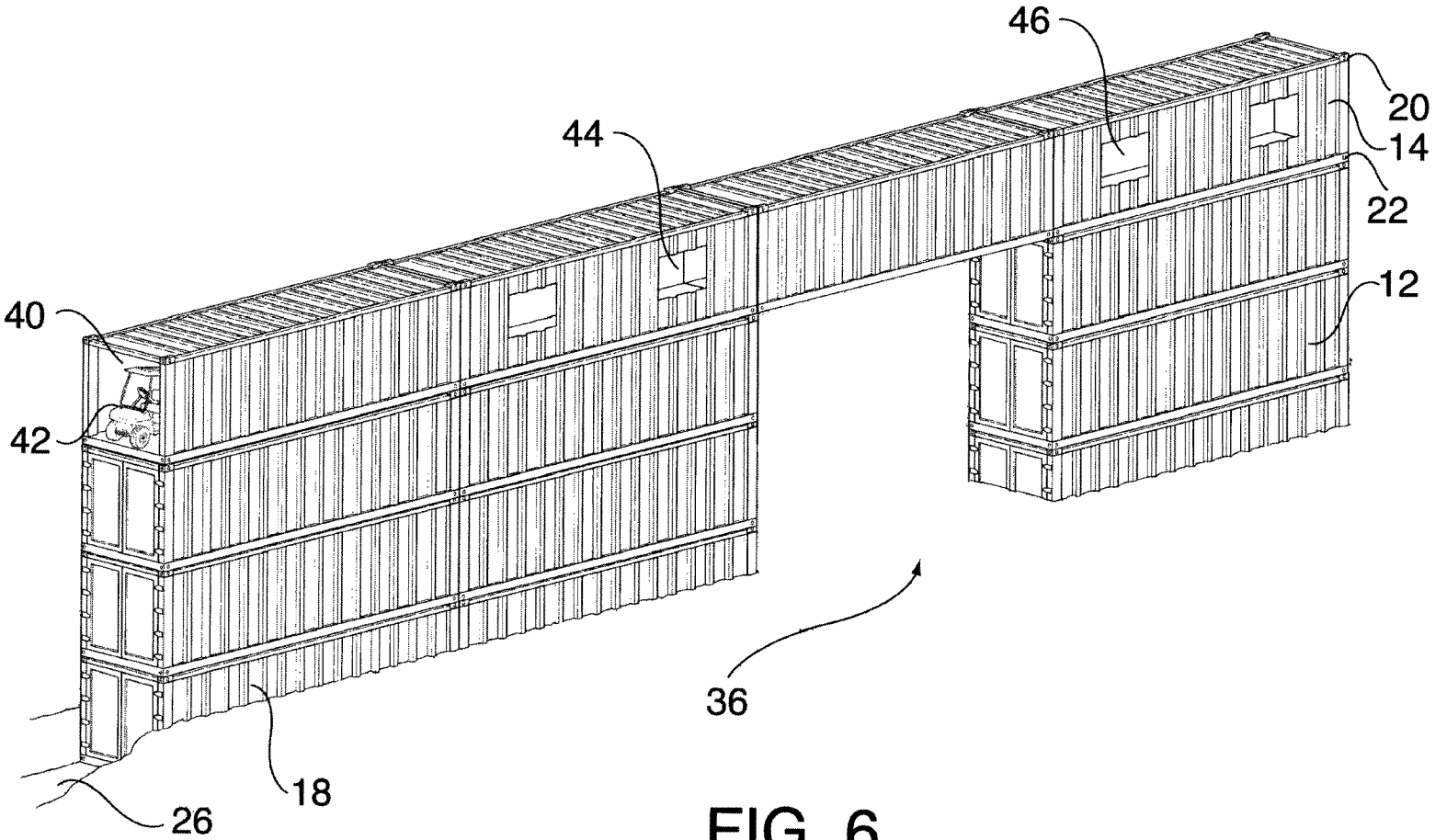
FIG. 6 is a front perspective view showing an opening in the border wall or fence.

When the barrier is constructed to extend for great distances, it may be necessary to provide an opening in certain places to allow a pass-through or even drive-through or a road or the like. As shown in FIG. 6, this can be accomplished by removing one container from the bottom row or from both the bottom and second rows, thereby creating an open space 36 to get from one side of the barrier to the other. That space 36 can then be closed by a sliding gate 38 or door or any other known means and opened only when desired.

In any one or all of the rows, it may also be desirable to remove the end walls such as shown at 40. This would form a passageway and would allow individuals to walk or vehicles 42 to drive through the length of the wall or through any portion thereof. (See FIGS. 6 and 7) Windows or small openings or peepholes or the like 44 and 46 can be positioned wherever desired so that personnel within the wall can observe what is happening outside of the wall.

The present invention may be embodied in other specific forms without departing from the spirit or essential attributes thereof and accordingly, reference should be made to the appended claims rather than to the foregoing specification as indicating the scope of the invention.

I claim:

1. A wall comprising:

a first plurality of shipping containers, said first plurality of shipping containers being longitudinally and horizontally aligned and adjacent shipping containers thereof being secured together at their respective opposing longitudinal ends to form a bottom row of containers, said bottom row of containers being positioned at least partially below ground level and being at least partially filled with dirt;

a second plurality of shipping containers, said second plurality of shipping containers being longitudinally and horizontally aligned and adjacent shipping containers being secured together at their respective opposing longitudinal ends to form a second row of containers, each of said second row of containers being vertically aligned with, positioned above and secured to a respective one of said bottom row of containers;

an opening through said bottom and second rows of containers formed by removing one of the containers from said second row and a vertically aligned container from said bottom row, and creating a pass-through from one side of the wall to the other;

a gate for closing said opening; and a third plurality of shipping containers, said third plurality of shipping containers being longitudinally and horizontally aligned and adjacent shipping containers thereof being secured together at their respective opposing longitudinal ends to form a third row of containers, said third row of containers horizontally extending over said opening and corresponding ones of said third row of containers being vertically aligned with, positioned above and secured to a respective one of said second row of containers.

2. The wall as claimed in claim 1 wherein the ends of the containers in said third row are open so that the interiors of the containers in said third row communicate with each other to form a pathway for individuals to walk or for vehicles to drive through at least a portion of said wall.

3. The wall as claimed in claim 1 further including windows in at least some of the containers in said third row of containers.

4. The wall as claimed in claim 1 including vertically extending metal plates vertically extending between said bottom, second and third rows of containers and welded to at least some of the joints between the adjacent longitudinal ends of said vertically aligned shipping containers.

* * * * *